US009371825B2

(12) United States Patent
Zaremba

(10) Patent No.: US 9,371,825 B2
(45) Date of Patent: Jun. 21, 2016

(54) FUEL TANK ARRANGEMENTS FOR SELF-PRIMING FLOATING PUMPS

(71) Applicant: Gary W. Zaremba, Regina (CA)

(72) Inventor: Gary W. Zaremba, Regina (CA)

( * ) Notice: Subject to any disclaimer, the term of this patent is extended or adjusted under 35 U.S.C. 154(b) by 289 days.

(21) Appl. No.: 14/177,379

(22) Filed: Feb. 11, 2014

(65) Prior Publication Data

US 2014/0238359 A1 Aug. 28, 2014

Related U.S. Application Data

(60) Provisional application No. 61/770,741, filed on Feb. 28, 2013.

(51) Int. Cl.

| | |
|---|---|
| ***F04B 17/05*** | (2006.01) |
| ***F04B 23/02*** | (2006.01) |
| ***F04B 53/22*** | (2006.01) |
| ***F04D 9/02*** | (2006.01) |

(52) U.S. Cl.

CPC ..... *F04B 17/05* (2013.01); *F04B 23/02* (2013.01); *F04B 23/021* (2013.01); *F04B 53/22* (2013.01); *F04D 9/02* (2013.01)

(58) Field of Classification Search

CPC ..... F04B 17/05; F04B 23/02; F04B 53/22; F04B 53/16; F04B 23/021; F04B 23/023; F04D 7/02; F04D 29/007; F04D 9/02; B60K 15/03; B60K 2015/03059; B60K 15/06

USPC ..... 417/61; 169/DIG. 1

See application file for complete search history.

(56) References Cited

U.S. PATENT DOCUMENTS

| | | | | | |
|---|---|---|---|---|---|
| 2,431,806 | A * | 12/1947 | Karey | B63H 20/10 | 123/196 W |
| 3,273,507 | A * | 9/1966 | Handford | F04D 13/066 | 210/923 |
| 3,348,791 | A * | 10/1967 | McKinlay | B64D 39/00 | 137/209 |
| 3,393,643 | A * | 7/1968 | Herman | F04D 13/066 | 239/18 |
| 3,397,647 | A * | 8/1968 | Daniel | F04D 13/066 | 239/725 |
| 3,400,664 | A | 9/1968 | Kingsep | | |
| 3,461,807 | A | 8/1969 | Morrison | | |
| 3,470,822 | A | 10/1969 | Evans et al. | | |
| 3,612,721 | A | 10/1971 | Evans et al. | | |
| 4,553,902 | A | 11/1985 | Eberhardt | | |
| 4,750,515 | A * | 6/1988 | Fukushima | F16K 31/22 | 137/448 |
| 5,624,238 | A * | 4/1997 | Herbert | A62C 25/00 | 417/234 |
| 7,461,637 | B2 * | 12/2008 | Yamashita | F01M 9/04 | 123/196 R |
| 2001/0035215 | A1 * | 11/2001 | Tipton | B60K 15/00 | 137/571 |
| 2006/0201213 | A1 * | 9/2006 | Burke | G02B 6/4451 | 70/168 |
| 2012/0043320 | A1 * | 2/2012 | Beem | F17C 1/16 | 220/4.14 |

* cited by examiner

*Primary Examiner* — Bryan Lettman
*Assistant Examiner* — Timothy P Solak
(74) *Attorney, Agent, or Firm* — Kyle R. Satterthwaite; Ryan W. Dupuis; Ade & Company Inc.

(57) ABSTRACT

An auxiliary fuel tank for portable self-priming floating pumps is configured to float independently of the pump while being retained therewith. The tank features an annular shape having a central opening that is sized to accommodate receipt of the pump, whereby the tank fits around the pump so as to move therewith over the body of water in which the pump is deployed.

20 Claims, 6 Drawing Sheets

DETAIL A

SEE DETAIL A

A
B
10
12
14
15
16
18
20
21
27a
27b
28
30
35
40
70
100

FUEL TANK ARRANGEMENTS FOR SELF-PRIMING FLOATING PUMPS

This application claims benefit under 35 U.S.C. 119(e) of U.S. provisional patent application Ser. No. 61/770,741, filed Feb. 28, 2013.

FIELD OF THE INVENTION

The present invention relates generally self-priming floating pumps that operate to pump liquid from a body of liquid on which they are placed, and more particularly to fuel tanks for supplying fuel to engines of such pumps.

BACKGROUND OF THE INVENTION

A number of different pumps of the aforementioned type have been patented and commercialized in the prior art for the purpose of pumping water from a body of water on which the pump is deployed. In their basic form, each such pump comprise an engine or motor mounted atop a pump housing containing an impeller that is rotatably driven by a vertical drive shaft from the engine. An inlet opening of the pump housing via which liquid is drawn into the pump from the body of water is situated at a bottom end of the pump housing, and an outlet through which the liquid is discharged is oriented generally radially of the vertical rotational axis of the impeller. A ring-shaped or annular float closes around the pump housing and has sufficient buoyancy such that, when placed onto the body of liquid, the inlet opening of the pump housing is submerged in the body of water, while the engine or motor remains safely elevated over same. A flexible hose coupled to the outlet conduit from the pump runs from the pump back to shore so that the water pumped by the unit can be distributed to the desired collection point or distribution area.

Such pumps are useful in disaster relief applications (e.g. removing flood waters), oilfield applications, construction applications, forestry/firefighting applications, and agricultural applications such as draining of sloughs, supplying of water to livestock, irrigating of farmland or removal of water from flooded areas, although other industries such as forestry and construction can likewise benefit from use of such pumps.

Examples of prior art self-priming floating pumps are found in U.S. Pat. No. 3,461,807 of Morrison, U.S. Pat. No. 3,400,664 of Kingsep, U.S. Pat. No. 4,553,902 of Eberhardt, and U.S. Pat. Nos. 3,612,721 and 3,470,822 of Evans et al.

To maximize portability and allow easy transport of a pump by one or two individuals, the pumps are typically of relatively small size, employing small scale engines that accordingly feature rather small onboard fuel tanks. Applicant has accordingly found that commercially available self-priming floating pumps are rather limited in terms of their uninterrupted operation time by the relatively small fuel capacity of the pump's existing fuel tank. That is, the run time of the pump between fuel top-ups is relatively low, often leading to the need to bring the pump back ashore for refueling part way through a large pumping job.

Accordingly, it would be desirable to provide a fuel tank solution of greater capacity for self-priming floating pumps.

SUMMARY OF THE INVENTION

According to a first aspect of the invention there is provided a fuel tank device for a self-priming floating pump, the fuel tank device comprising a float device arranged to be floatable independently of the self-priming floating pump and a fuel chamber carried by the float device for floating support of the fuel chamber by the float device.

Preferably the fuel tank device spans more than 180-degrees around an axis passing through an empty space that is bordered by said fuel tank device and dimensioned to accommodate receipt of the self-priming floating pump within said space in a manner at least partially circumscribed by the fuel tank device.

The fuel tank device may span at least 270-degrees around the axis in some embodiments, at least 300-degrees in some embodiments, and at least 315-degrees in some embodiments, and at least 330-degrees in other embodiments.

Preferably the fuel tank device has an annular shape closing fully around the open space delimited thereby.

Preferably the fuel tank device, over at least a partial span of a height thereof, comprises a gap in a span of the fuel tank device around the axis, the gap being of sufficient size to accommodate an outlet conduit of the self-priming floating pump.

Preferably there is provided at least one upper blocker carried at a topside of the fuel tank device and movable between an extended position projecting inwardly from the fuel tank device over the open space bordered thereby the fuel tank device and a retracted position withdrawn from over the open space bordered by the fuel tank device.

Preferably there is provided at least one lower blocker carried at an underside of the fuel tank device and movable between a deployed position projecting inwardly from the fuel tank device beneath the open space bordered by the fuel tank device and a withdrawn position retracted from beneath the open space bordered by the fuel tank device.

The upper and lower blockers are preferably be movable together as part of a same blocking mechanism.

Preferably a distance between the upper blocker and the lower blocker is at least as great as a height dimension of the self-priming floating pump at an outer periphery of a float body thereof, whereby the blockers are deployed above and below the float body of the self-priming floating pump.

For at least one blocker, there is preferably provided a stop feature for preventing inadvertent movement of said at least one blocker between the two positions.

The stop feature is preferably an integral part of the fuel tank device.

Preferably the float device comprises a hollow body inside which the fuel chamber is contained.

Preferably walls of the hollow body define walls of the fuel chamber.

Preferably the fuel chamber and the hollow interior of the hollow body are one in the same.

Preferably the walls of the hollow body are formed of a material of lower density than water.

There may be provided a fuel pump for installation on an engine of the self-priming floating pump to draw fuel from the fuel tank device under operation of said engine.

There may be provided a fuel selection valve having an outlet port for connection to a fuel inlet of the self-priming floating pump, first and second inlet ports for respective connection to an outlet of an existing fuel tank of the self-priming floating pump and the fuel chamber of the fuel tank device, and an actuator operable to selectively switch between a first mode communicating the first inlet port to the output port and a second mode communicating the second inlet port to the output port.

There may be provided a fuel filter for installation in a fuel line connection between the fuel chamber of the fuel tank device and a fuel intake of the self-priming floating pump.

According to a second aspect of the invention there is provided a self-priming floating pump comprising an engine arranged for floating support over a body of liquid under placement of an inlet of an underlying pumping mechanism driven by said engine into said body of liquid, and a fuel tank coupled to said engine and arranged to provide fuel thereto for operation of said engine, wherein the fuel tank is arranged to span more than 180-degrees around a rotational axis of the pump.

The fuel tank may be positioned so as to be at least partially submerged in the body of liquid under placement of the inlet of the underlying pump mechanism into said body of liquid.

According to a third aspect of the invention there is provided a self-priming floating pump comprising an engine arranged for floating support over a body of liquid under placement of an inlet of an underlying pumping mechanism driven by said engine into said body of liquid, and a fuel tank coupled to said engine and arranged to provide fuel thereto for operation of said engine, wherein the fuel tank is positioned so as to be at least partially submerged in the body of liquid under placement of the inlet of the underlying pump mechanism into said body of liquid.

According to a fourth aspect of the invention there is provided a method of increasing an achievable operating time of a self-priming floating pump having a engine with an onboard fuel tank of predetermined size, the method comprising connecting a secondary fuel tank of a floatable fuel tank device to the engine of said self-priming floating pump in a manner arranged to supply fuel from said secondary fuel tank to the engine.

Preferably the secondary fuel tank of the floatable fuel tank device has a greater fuel capacity than said onboard fuel tank of the self-priming floating pump.

BRIEF DESCRIPTION OF THE DRAWINGS

In the accompanying drawings, which illustrate exemplary embodiments of the present invention.

DETAILED DESCRIPTION

Figure 1:
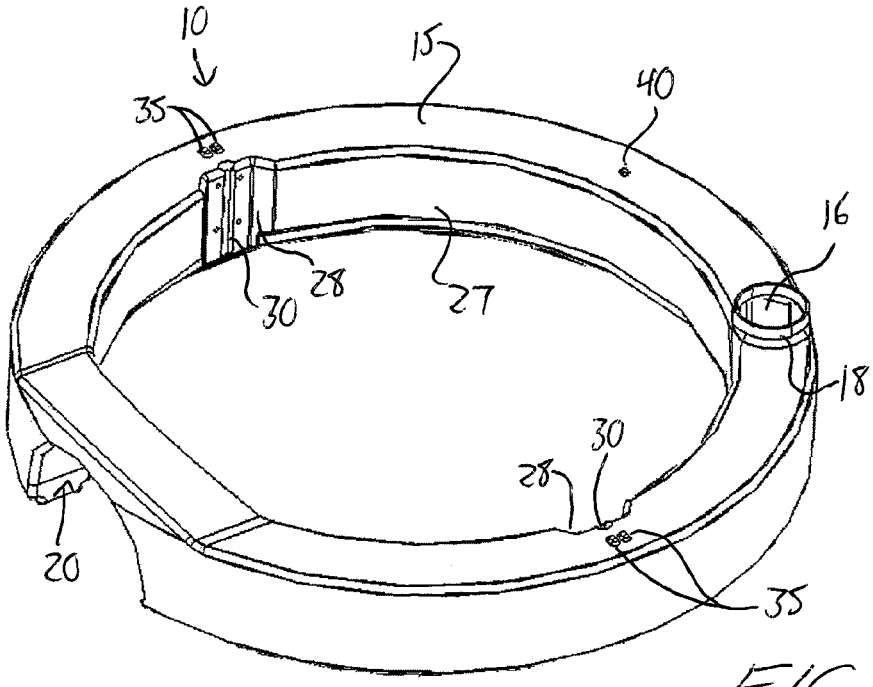
FIG. 1 is a perspective view of a floating fuel tank of the present invention for use with a self-priming floating pump.
Figure 2:
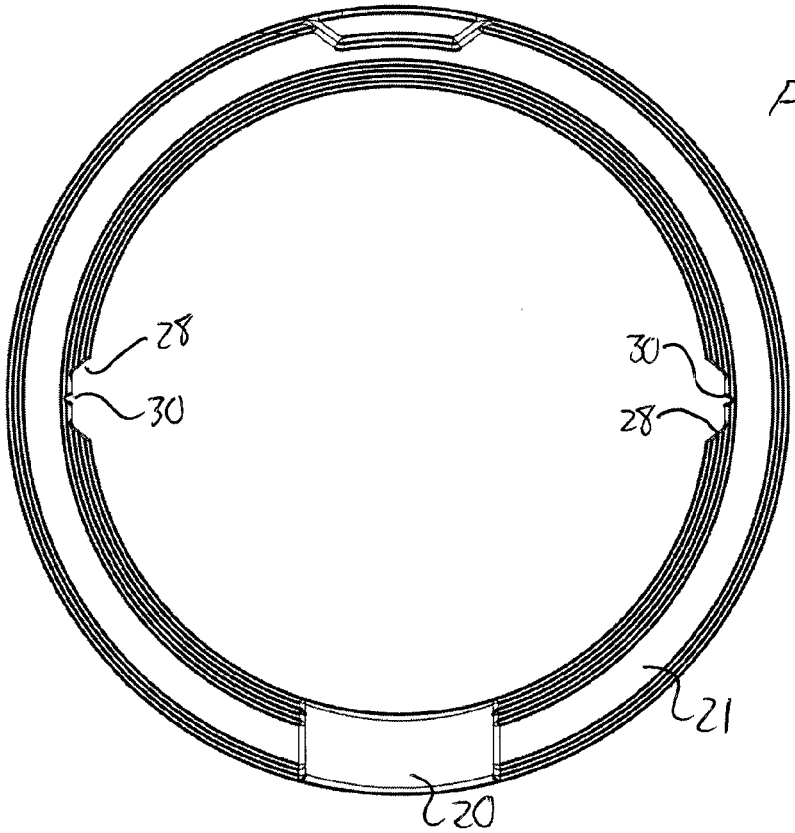
FIG. 2 is a bottom plan view of the floating fuel tank.

FIG. 1 shows a portable floating fuel tank according to one embodiment of the present invention. The fuel tank 10 is ring-shaped or annular in form so as to close fully around an open central space 12 bordered by the tank on all sides. The open central space 12 has a diameter exceeding the outer periphery of a float body of a portable self-priming floating pump 100. With brief reference to FIG. 9, the floating fuel tank 10 of the present invention can thus be placed around the float body 102 of the self-priming floating pump 100 so that the two units will move together as a collective assembly under movement of the pump along the surface of a body of water on which the units are placed.

Turning back to FIG. 1, the floating fuel tank is preferably formed of a material of lower density than water, for example being a hollow one-piece product rotationally molded from cross-linked low density polyethyelene (LDPE), a material known to be suitable for fuel tanks. In such an embodiment, the interior volume of the container is hollow throughout, creating an annular chamber or channel extending around the full circumference of the central open space bound by the tank. As gasoline has a lower density than water, the fuel tank itself will float on water regardless of the level to which the hollow interior space 14 of the tank if filled with gasoline, i.e. regardless of the air to fuel ratio contained in within the hollow interior of the tank at any given time. Accordingly, the tank will be buoyant on a body of water even when its entire internal capacity is filled with gasoline, and will grow only more buoyant as gasoline is drawn off from the fuel tank during use of the self-priming floating pump.

A flat upper surface 15 at a top wall of the tank 10 features a fill port 16 opening into the hollow interior space of the tank, with an externally threaded neck 18 projecting a short height upward from the tank surface around the fill port for receipt of a threaded cap (not shown) to close off the fill port when not being used to introduce fuel into the tank.

Figure 9:
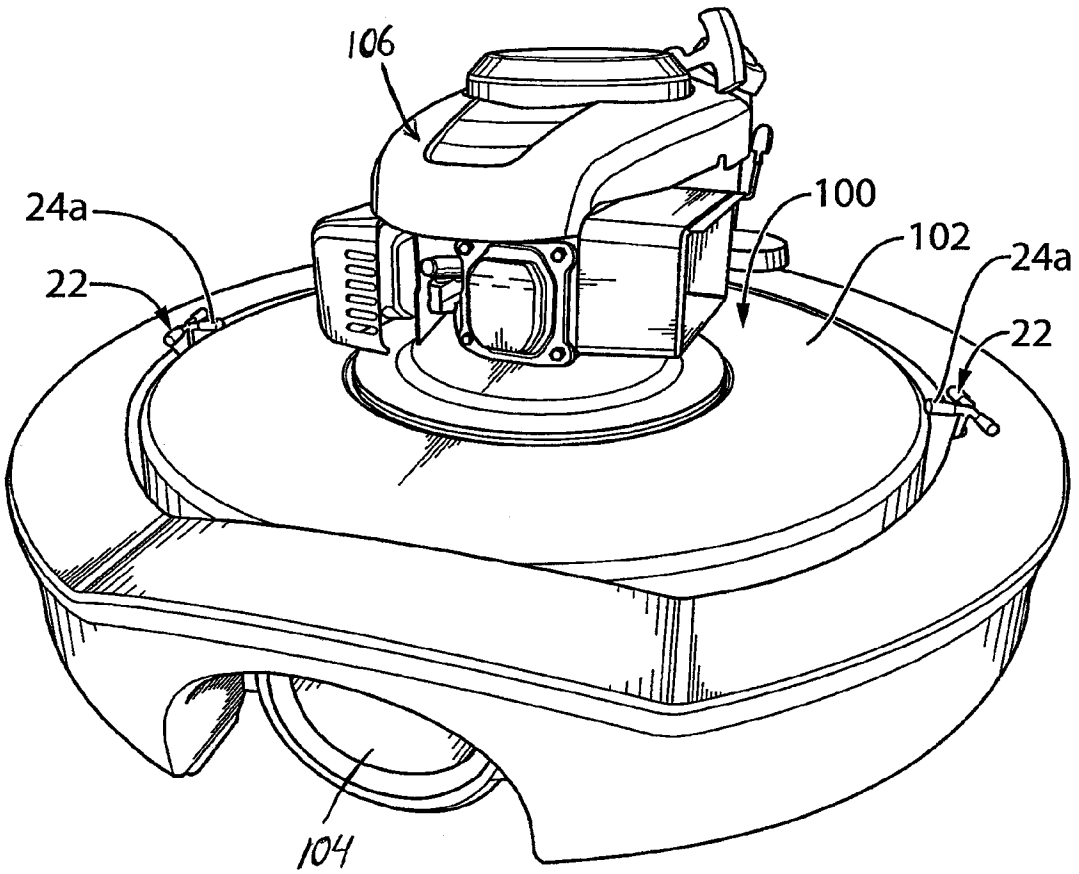
FIG. 9 is a perspective view of the floating fuel tank installed on a self-priming floating pump.

At a position spaced around the ring-shaped tank from the fill cap, an arc-shaped cutaway 20 juts into the tank from a flat bottom surface 21 of a bottom wall thereof and spans fully from the inner wall of the tank's annular shape to the outer wall thereof. The arc-shaped characteristic of the cutaway refers to its cross-sectional shape in planes perpendicular to a radius of the tank's circular ring shape. Turning briefly to FIG. 9 again, this cutaway area 20 recessed from the underside of the tank accommodates an outlet conduit 104 of the self-priming floating pump 100 that juts radially out from the float body 102 thereof. In FIG. 9, the conduit itself does not fully pass cross the tank to a position radially outward therefrom, and so the archway also accommodates passage therethrough of a flexible hose (not shown) that is coupled to the outlet conduit to deliver the pumped water ashore. While the illustrated cutaway is arch-shaped so as to generally conform to the cylindrical shape of the outlet conduit, it will be appreciated that other shapes of sufficient size to accommodate the outlet conduit may instead be used. It will also be appreciated that the term 'cutaway' is referring to the general appearance, and not particularly to the manner in which the feature is formed, particularly in the illustrated embodiment where the tank is an integral, one-piece molded construction, and thus no 'cutting away' of material is involved in creating the 'cutaway'. However, other materials and fabrication processes other than plastic molding are within the scope of the present invention.

While the fuel tank 10 of the illustrated embodiment is self-floating so as to be floatable on the body of water independently of the self-priming floating pump 100, the buoyancy of the fuel tank 10 will increase as gasoline is drawn from the hollow interior of the tank. Depending on where the engine emissions of the self-priming pump are exhausted, this may cause concern with some self-priming floating pumps if the increasing buoyancy of the tank 10 will cause it to rise up to an elevation blocking the engine exhaust. Accordingly, the illustrated embodiment employs a pair of holding mechanisms 22 disposed at diametrically opposed positions on the tank to hold the tank elevationally in-line with the float 102 of the self-priming pump so as not to rise or fall relative thereto when the pump and fuel tank are placed on the water and engaged together by these mechanisms 22.

Figure 11:
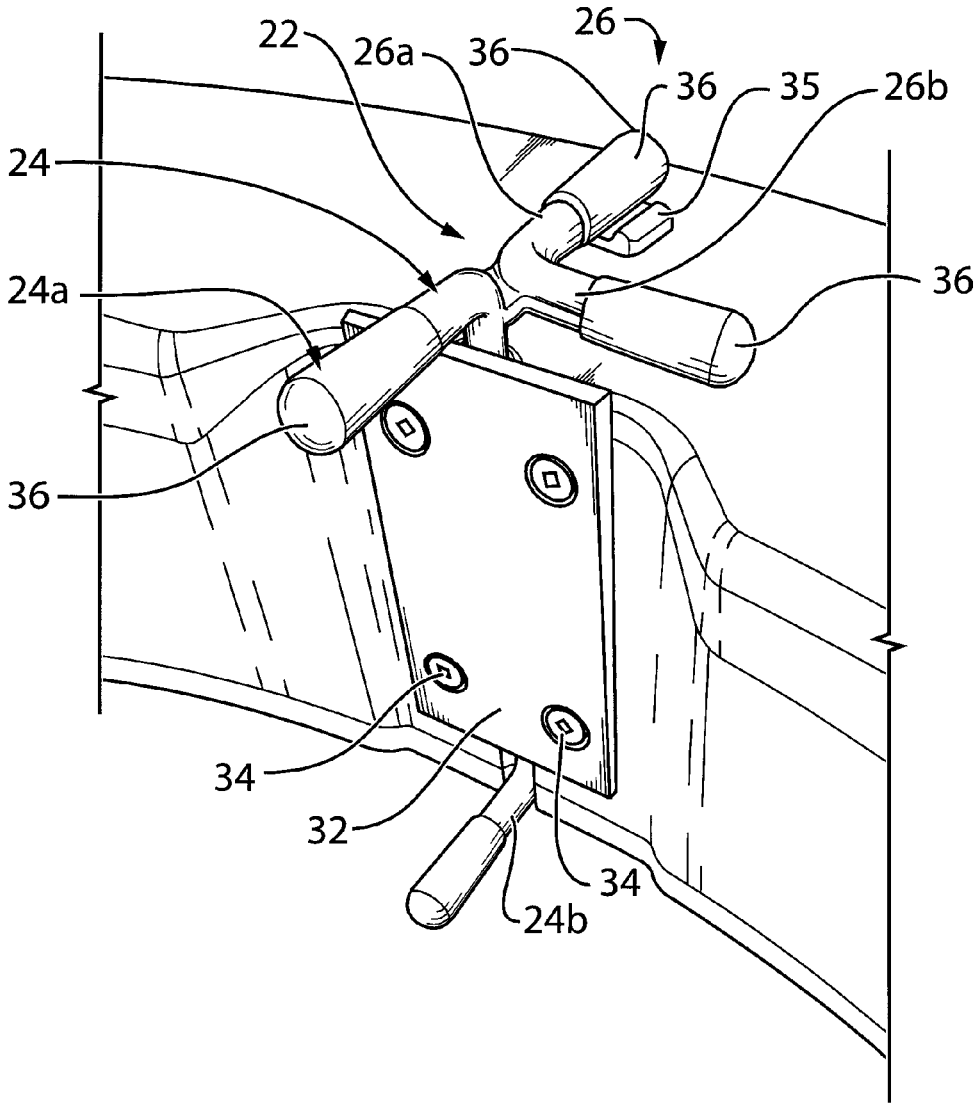
FIG. 11 illustrates a holding mechanism operable to hold the floating fuel tank at a same elevation as the self-priming floating pump.

Turning to FIG. 11, each holding mechanism features a metal rod or bar 24 bent in two places to form a square C shape, with two generally parallel legs 24*a*, 24*b* separated by a central span running generally perpendicular to the two legs projecting from its opposite ends. A second bar 26 features a single bend of approximately 90-degrees so as to have an L-shaped form. The L-shaped bar 26 is welded to the C-shaped bar 24 at a position placing one leg 26*a* of the L-shaped bar generally in-line with one leg 24*a* of the C-shaped bar on a side of the C-shaped bar's central span lying opposite that to which the C-shaped bar's legs 24*a*, 24*b* project. The second leg 26*b* of the L-shaped bar 26 lies generally perpendicular to the aligned legs 24*a*, 26*a* of the two bars 24, 26 in the same plane as these aligned legs, and thus lies generally perpendicular to the central span of the C-shaped bar 24 as well.

Figures 3, 4, 5, 6, 7, 8, 13:
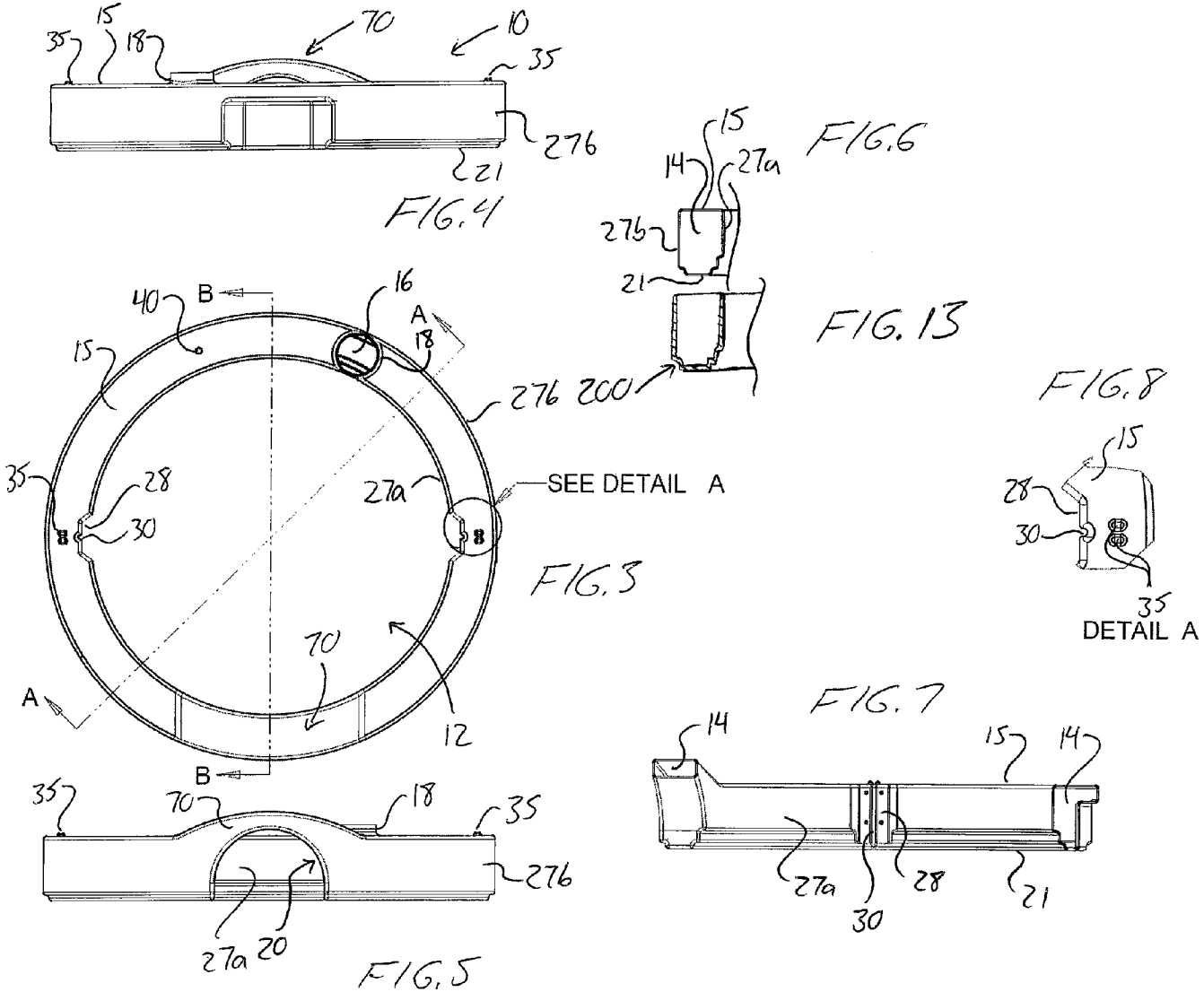
FIG. 3 is a top plan view of the floating fuel tank.
FIG. 4 is a side elevational view of the floating fuel tank.
FIG. 5 is a side elevational view of the floating fuel tank from a side thereof opposite that of FIG. 4.
FIG. 6 is a partial cross-sectional view of the floating fuel tank as taken along line A-A of FIG. 3.
FIG. 7 is a cross-sectional view of the floating fuel tank as taken along line B-B of FIG. 3
FIG. 8 is a partial overhead plan view of the floating fuel tank, detailing an area marked by detail circle A of FIG. 3.
FIG. 13 illustrates a partial cross-sectional view, as taken along the same plane as FIG. 6, of a fuel containment device of annular shape for attachment to the self-priming reciprocating pump in a position closing around the float thereof for receipt of an annular fuel tank inside the containment device.

Turning briefly to detail A of FIG. 3, or to the close-up thereof in FIG. 8, a trapezoidal recess 28 juts into the tank at the interior side wall 27*a* thereof that faces into the open space 12 at each one of the two diametrically opposite positions at which the holding mechanisms are to be installed on the tank. The trapezoidal shape refers to the shape in horizontal planes parallel to the flat upper and lower surfaces 15, 21 at the top and bottoms walls of the tank, and the recess spans the full height of this part of the tank from the top wall to the opposing bottom wall of the tank. At a center of each trapezoidal recess, a smaller arcuate recess 30 juts further into the tank, and again spans the full height of the part of the tank in question.

Turning back to FIG. 11, the central span of the C-shaped bar 24 of one of the holding mechanism is received in the arcuate recess 30 at one of the two diametrically opposite locations on the tank in a vertical orientation placing the L-shaped bar 26 at an elevation over the flat upper surface 15 at the top wall of the tank 10, along with the first leg 24*a* of the C-shaped bar 24, and placing the second leg 24*b* of the C-shaped bar at an elevation below the flat lower surface 21 at the bottom wall of the tank 10. In plan view, the L-shaped bar 26 and the top leg 24*a* of the C-shaped bar 24 form a T-shaped member supported atop the central span of the C-shaped bar 24. One or more metal plates 32 are fastened in place to the inner wall of the tank at the trapezoidal recess 28 on opposite sides of the arcuate recess 30, for example by screws 34, so that the plate(s) span across the arcuate recess to trap the central span of the C-shaped bar 24 therein.

On the flat upper surface 15 of the tank at a short distance radially outward from the each arcuate recess 30, a pair of integral protuberances 35 jut a short height upward from the flat upper surface 15 on opposite sides of a radius of the tank on which this arcuate recess 30 resides. Each of the three legs of the T-shaped member atop the tank is fitted with a resilient cap 36, for example of rubber or PVC material. The length of the central span of the C-shaped bar provides enough clearance so that pivoting of the C-shaped bar about the vertical axis of its central span will allow movement of its horizontal legs 24*a*, 24*b* over and under the flat upper and surfaces of the tank respectively. However, at the top of the tank, the cap 26 on each leg provides a level of interference with the elevation of the protuberance 35, but by an amount that will only resist, and not fully prevent, attempted manual pivoting of the assembled bars 24, 26 out of a position in which one of their upper legs 24*a*, 26*a*, 26*b* resides between the two protuberances 35. The resistance is sufficient that any such leg 24*a*, 26*a*, 26*b* of the T-shaped member cannot self-pivot out of such position, but can be manually pivoted out the position by manually forcing the leg over one of the protuberances, during which the underside of the cap is compressed or deflected by the protuberance to allow this passage of the leg thereover.

FIG. 11 shows the blocking mechanism in a deployed or extended position in which one of the two parallel legs 26*a* of the T-shaped member is engaged between the protuberances 35, whereby the other one of the two parallel legs 24*a* juts inwardly from the tank over the open space 12 bound thereby, and the lower leg 24*b* of the C-shaped bar 24 juts inwardly from the tank under the open space 12. A retracted or withdrawn position is achieved by manually pivoting the blocking mechanism out of this position, against the resistance provided by interaction between a respective one of the protuberances 35 and the cap 36 on the respective upper leg 26*a*, and continuing to pivot the blocking mechanism in the same direction until the perpendicular leg 26*b* of the T-shaped member is instead forced into the self-locking position between the protuberances 35. In this position, none of the legs jut inwardly to overlie and underlie the open space 12 bound by the tank, as the two parallel legs 24*a*, 26*a* of the T-shaped member lie parallel to the closed end of the trapezoidal recess 28 (i.e. lie tangential to the tank radius at the arcuate recess 30) and the other two legs of the blocking mechanism 24*b*, 26*b* jut outwardly over the tank (i.e. lie on the radius of the tank in a position residing directly over and under the top and bottom walls thereof). In either position, the protuberances define a stop feature by which self-pivoting of the mechanism out of the current position is prevented.

Turning again to FIG. 9, moving of the two blocking mechanisms into the withdrawn or retracted positions completely opens up the open space 12 bound by the tank 10 from above and below, thereby allowing receipt of the float member 102 of the self-priming floating pump 100 into this space 12 by lowering of the tank 10 from over the self-priming floating pump 100 into the installed position closing around the float member 102 thereof. The height of the tank 10 between the flat upper and lower surfaces at the top and bottom walls thereof is similar to that of the float member 102 of the self-priming floating pump 100, whereby the distance between the top and bottom capped legs 24*a*, 24*b* of the C-shaped bar of each blocking mechanism slightly exceeds the height of the pump's float member 102. This way, with the tank 10 lowered into place to situate its flat upper and lower surfaces 15, 21 generally flush with the top and bottom surfaces of the pump's float member 102, pivoting of the blocking mechanisms into the deployed or extended positions acts to place the two legs 24*a*, 24*b* of each C-shaped bar in positions reaching over and under the outer periphery pump's float member 102. As a result, relative vertical movement between the self-priming floating pump 100 and the fuel tank 10 of the present invention is prevented, or notably limited. That is, the legs of the C-shaped bars block vertical movement of the float member 102 of the self-priming floating pump 100 relative to the tank 10, whereby the tank 10 is maintained at a same elevation as the float member of the self-priming pump. This way, the tank cannot rise upward relative to the float member into a position blocking the exhaust from the engine of the self-priming pump 100.

It will be appreciated that mechanisms operable to move blocking members between deployed positions block the float body of the self-priming pump and retracted positions withdrawn from the float body may be employed in place of the described holding mechanisms using bent bars pivotally held in a recess of the tank by a one or more plates. Even where the described shape and operation of the illustrated holding mechanisms is used, materials other than metal may of course be employed. Where metal is used, it is preferably appropriately coated for corrosion resistance, for example using known powder coating techniques. Use of holding mechanisms at multiple locations around the ring-shaped tank is preferred over use of a single holding mechanism to prevent the tank from tilting relative to the self-priming floating pump. The span of the tank over the pump's outlet conduit at the cutaway of the tank prevents sinking of this portion of the tank relative to the pump, which may be sufficient together with only one-underside blocking member to prevent any tilting of the tank from a sinking action. While the illustrated embodiment has the advantage of providing both top and bottom blockers deployed through a single motion of one mechanism, other embodiments may have separately actuated top and bottom blocking members.

Figure 12:
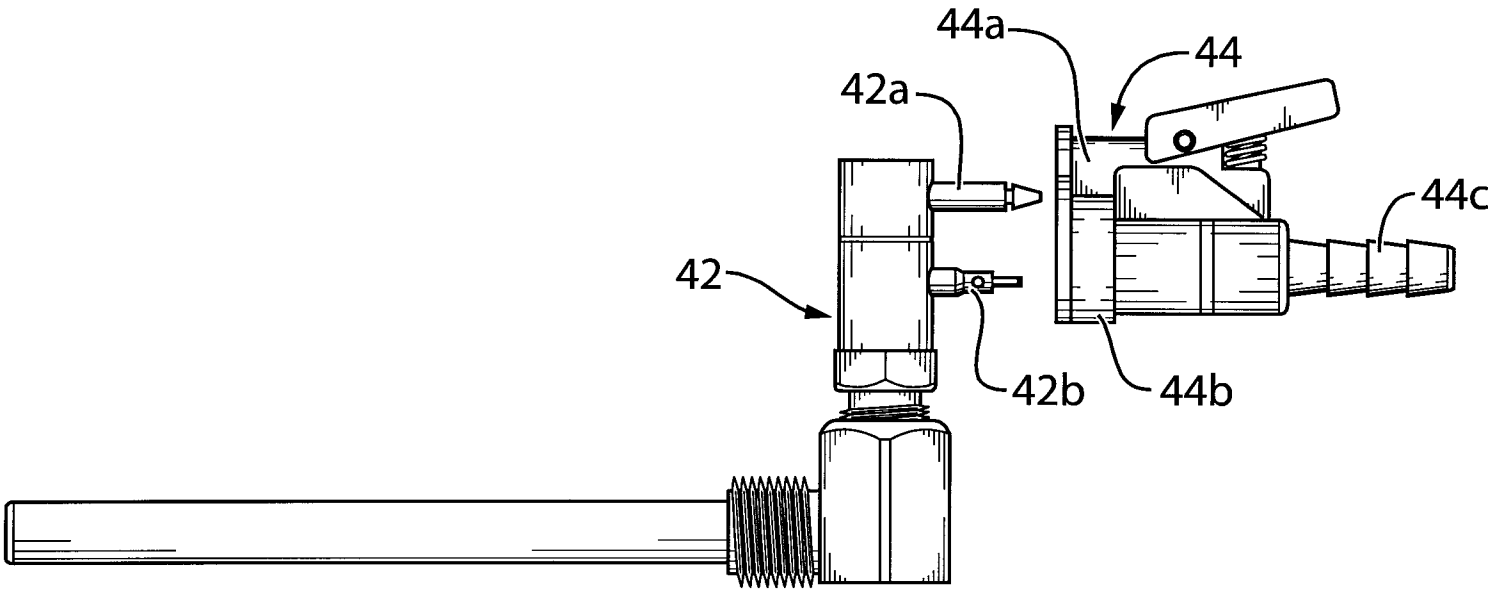
FIG. 12 illustrates a fuel draw tube and failsafe coupling for use in communicating the fuel tank contents with a connection line to a fuel inlet at the engine of the self-priming floating pump.

As best shown in FIG. 3, a fuel draw port 40 is provided in the upper surface 15 of the tank 10 at a position spaced around the tank from each of the fill port 16, the cutaway 20 and the blocking mechanisms 22. FIG. 12 shows a fitting 42 that is engaged into the fuel draw port 40 and is connected to a fuel draw tube 44 that depends down into hollow interior 14 of the tank to near the bottom wall thereof. The fitting 42 is of a known type having two male connection points 42*a*, 44*b* for mating with two female connection points 44*a*, 44*b* of a respective fitting 44 mounted on the end of a fuel delivery hose (not shown). The fittings feature a known valve configuration used as a marine fuel line quick disconnect, whereby flow is allowed through the male-female connection of one mating pair of connections points 44*b* only if the male-female connection of the other mating pair of connection points is intact. Accordingly, should the fittings be separated somehow, flow of fuel from the tank through the fitting 42 at the fuel draw port is automatically cut off. The fittings thus cooperate together to provide a failsafe coupling that cuts of the fuel supply from the tank when de-coupled. When flow is allowed, the flow of fuel passes through the fuel draw tube 44 into an inlet end 42*c* of the fitting 42 at the fuel draw port, onward through the outlet of this fitting 42 at connection point 42*b* and into the inlet at connection point 44*b* of the fitting 44 on the fuel delivery hose. The fuel delivery hose connects to an outlet of this fitting 44, for example by way of a barbed hose connector 44*c*.

Figure 10:
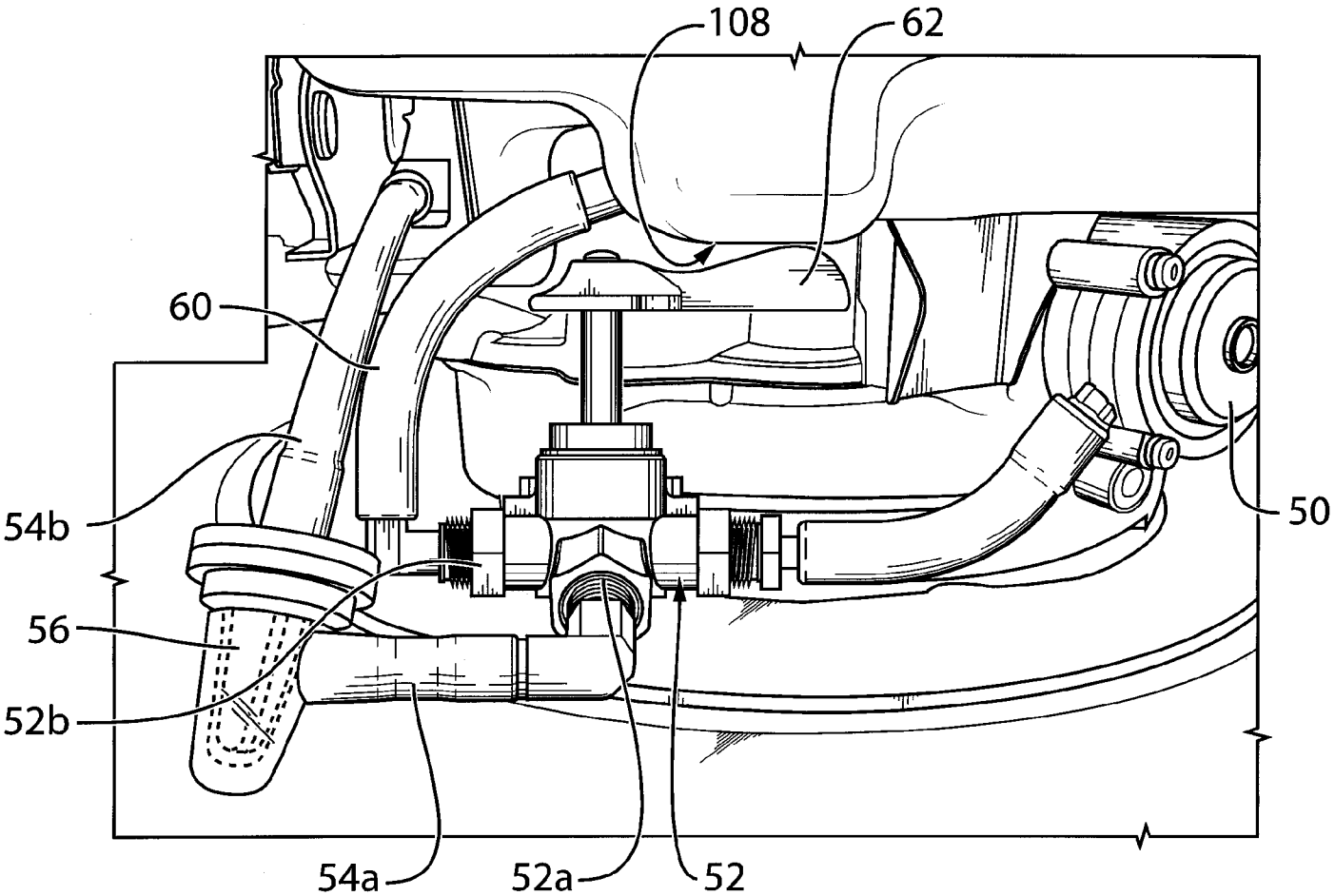
FIG. 10 is a perspective view illustrating a fuel selection valve operable to select whether an engine of the self-priming floating pump draws fuel from an existing onboard fuel tank of the self-priming floating pump or the floating fuel tank of the present invention.

Turning now to FIG. 10, if not already equipped with one, the engine 106 of the self-priming floating pump is modified to add a fuel pump 50, which is connected to a fuel selection valve 52. An outlet port 52*a* of the fuel selection valve 52 is connected to a fuel inlet of the engine 106, for example via lengths of flexible hose 54*a*, 54*b* and an in-line fuel filter 56 connected therebetween. One inlet port 52*b* of the valve 52 is connected to an outlet of the engine's existing on-board fuel tank 108, for example by flexible hose 60 that replaces, or is a rerouted configuration of, a hose that previously coupled the outlet of the onboard fuel tank 108 directly to the fuel inlet of the engine. A second inlet port (not shown) of the valve 52 connects to the fuel delivery hose that is coupled to the floating tank 10 of the present invention. An actuator of the valve 52, for example a manual handle 62 thereof, is operable to switch the valve between a first condition that fluidly communicates the first inlet port 52*b* of the valve to the outlet port 52*a* thereof, and a second condition that instead fluidly communicates the second inlet port of the valve 52 to the outlet port 52*a*. The fuel pump 50 operates in a known manner in response to reciprocating operation of the engine to draw fuel to the valve from the selected source, i.e. from either the existing onboard tank of the self-priming floating pump or the auxiliary tank of the present invention, which has a greater volumetric capacity than the original onboard tank, depending on the operator selected position of the valve 52.

The illustrated embodiment not only increases the amount of fuel available for engine to allow increased operation time of the self-priming floating pump, but also may improve engine performance or maintenance requirements by adding the fuel filter between the fuel intake of the engine and each fuel tank.

The tank 10 of the illustrated embodiment features an arched section 70 that overlies the cutaway, and at which the top wall of the tank bulges upward from the flat upper surface 15 that forms the substantially majority of the top wall's outer surface. This configuration is intended to fit a particular pump style in which the outlet conduit of the self-priming floatable pump is of notable size reaching or substantially reaching a height of the topside of the pump's float body, and so the arch-shaped cutaway needs to reach upwardly to or slightly beyond the flat upper surface 15 of the tank. The arched section 70 thus achieves the closed status of the annular tank's full 360-degree span, while placing the majority of the top wall of the tank at a lower elevation, for example to minimize interference with the flow of engine exhaust and to allow the above described use of blocking mechanisms reaching inward over the pump's float body to block relative vertical movement of the pump 100 and tank 10. However, other embodiments may not require an arched section peaking to a higher elevation than a remainder of the tank's topside, for example for use with self-priming floating pumps having smaller outlet conduits or pumps where rising of the tank relative to the pump is not a concern for blocking of the engine exhaust path.

While the illustrated embodiment employs a fully-closed annular form spanning a full circumference around the float member of the self-priming floating pump, and using a cutaway-like feature at the underside to create a gap in this full-ring closure over part of the tank's height to accommodate the outlet conduit of the self-priming floating pump, other embodiments may instead close less than 360-degrees around the axis of the open space for accommodating the pump's float member while still spanning a majority of the circumference therearound so that the tank won't separate from around the pump float.

Although the illustrated embodiment employs a fuel selection valve to allow user-control over whether the pump uses the existing on board tank or the auxiliary tank of the present invention, other embodiments may omit this valve. In some embodiments, the larger tank may be more permanently attached to the self-priming floating pump, in which case an option for future use of the original onboard fuel tank after installation of the larger tank may not be required. Even where the tank is separate and detachable and described in the detailed embodiment, it may form the sole fuel supply of a pump particularly manufactured to use this tank. This way, the pump manufactured in accordance with the present invention has the advantage of a larger fuel tank than the prior art, but doesn't suffer from lack of portability where the full tank and pump together are too heavy for carrying by a single person as a combined unit, as the fuel tank and pump can be detached from one another and carried separately to the point of deployment onto the body of water.

While the illustrated embodiments are described in terms of a self-floating, add-on auxiliary fuel tank for an existing self-priming floating pump, other embodiments are also contemplated within the scope of the present application. For example, a tank spanning partially or fully around the center of the pump provides the advantage of increased fuel capacity compared to conventional rectangular on board fuel tanks of the small engines typically used on self-priming floating pumps, and thus may be incorporated as original factory equipment on such pumps. If the float member of a self-priming floating pump provides sufficient buoyancy to carry the added weight of an auxiliary aftermarket fuel tank, or a larger factory-installed fuel tank, then the tank itself need not necessarily be buoyant or capable of self- or independent-floating. Tanks spanning more than 180-degrees around the float body of the self-priming pump have the advantage of automatically preventing horizontal separation or withdrawal of the tank from the self-priming floating pump. However, smaller tanks spanning less than half of the float body circumference may also be employed, for example by way of some other fastened or tethered connection or attachment the pump, for example by way of some type of clamping mechanism.

While the illustrated embodiment employs a round tank of circular inner and outer circumference, other embodiments closing partially or fully around the pump may have other shapes, for example a square or rectangular tank featuring straight tank segments spanning respective sides of a path around the central pump-receiving opening of the tank. The shape of the inner and outer peripheries of the tank may or may not match one another. For example, a tank with a square outer periphery may still feature a circular central opening 12 like that of the illustrated embodiment for a generally conforming fit with a round pump.

Although the above detailed embodiment is described in terms of using the tank design itself to provide its own buoyancy regardless of its level of fuel versus air content, other embodiments need not necessarily rely on the walls of the fuel-containing chamber to also define the walls of the float and/or overall tank device structure. For example, the float-providing structure of the tank device need not necessarily be a hollow structure whose entire interior is also the fuel-accommodating space of the device. For example, another embodiment could feature placement of a tank atop an annular floatation platform closing around the float body of the self-priming floating pump, in which case the tank itself need be of a self-floating design, but the overall tank-providing device is still floatable independently of the pump.

FIG. 13 illustrates another example of another configuration of enabling use of an annular tank that need not necessarily be of self-floating design. In this embodiment, a containment trough 200 of annular form has a cross-sectional shape conforming to the exterior surfaces of the bottom wall 21 and inner and outer side walls 27*a*, 27*b* of the tank 10. Upon seating of the tank 10 inside the trough 200, the trough forms a secondary skin effectively doubling the bottom and side walls of the tank so that any potential leakage from the tank is contained by the trough, thus providing an environmental fail safe to prevent fuel from leaking into the body of water. The side walls of the skin may have a height exceeding that of the side walls of the tank.

The containment trough 200 is attached, permanently or releasably, to the self-priming pump, so as to reside adjacent the outer periphery of the pump's float body, as described for the self-floating tank embodiments above, whereby placement of the tank into the containment trough places the tank in this position closing around the float body of the self-priming floating pump. The trough may be sold as an add-on accessory for the tank of the other embodiments whereby user's can add the trough based on a user-desire for additional environmental protection, or based on environmental laws or restrictions imposed by a governing authority in the user's jurisdiction.

When used with the containment trough, the holding mechanisms are removed or omitted from the tank so as not to prevent seating thereof in the trough, in which case the holding mechanisms are not required anyway, as the tank elevation will follow that of the pump based on the tank's seated position inside the trough. It will be appreciated that a suitable containment trough need not have a 'skin tight' fit with the tank in order to provide an effective fuel containment solution, and so the trough shape and dimensions need not necessarily conform to the tank. The trough may incorporate an openable and closeable cover lid for enclosing or holding down the fuel tank remains in the seated position within the trough.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A fuel tank device for a self-priming floating pump, the fuel tank device comprising a float device arranged to be floatable independently of the self-priming floating pump and a fuel chamber carried by the float device for floating support of the fuel chamber by the float device;

wherein:

the fuel tank device spans more than 180-degrees around an axis passing through an open space that is bordered by said fuel tank device and dimensioned to accommodate receipt of the self-priming floating pump within said open space in a manner at least partially circumscribed by the fuel tank device; and the fuel tank device, over at least a partial span of a height thereof, comprises a gap in a span of the fuel tank device around the axis, the gap being of sufficient size to accommodate an outlet conduit of the self-priming floating pump.

2. The device of claim 1 wherein the fuel tank device has an annular shape closing fully around the open space, and the gap is defined over only the partial span of the fuel tank device by a cutaway recessed into an underside of the fuel tank device.

3. The device of claim 1 wherein the float device comprises a hollow body inside which the fuel chamber is contained.

4. The device of claim 3 wherein walls of the hollow body define walls of the fuel chamber.

5. The device of claim 3 wherein the fuel chamber and the hollow interior of the hollow body are one in the same.

6. The device of claim 3 wherein the walls of the hollow body are formed of a material of lower density than water.

7. The device of claim 1 in combination with a fuel pump for installation on an engine of the self-priming floating pump to draw fuel from the fuel tank device under operation of said engine.

8. The device of claim 1 in combination with a fuel selection valve having an outlet port for connection to a fuel inlet of the self-priming floating pump, first and second inlet ports for respective connection to an outlet of an existing fuel tank of the self-priming floating pump and the fuel chamber of the fuel tank device, and an actuator operable to selectively switch between a first mode communicating the first inlet port to the output port and a second mode communicating the second inlet port to the output port.

9. The device of claim 1 in combination with a fuel filter for installation in a fuel line connection between the fuel chamber of the fuel tank device and a fuel intake of the self-priming floating pump.

10. A fuel tank device for a self-priming floating pump, the fuel tank device comprising a float device arranged to be floatable independently of the self-priming floating pump and a fuel chamber carried by the float device for floating support of the fuel chamber by the float device;

wherein:

the fuel tank device spans more than 180-degrees around an axis passing through an open space that is bordered by said fuel tank device and dimensioned to accommodate receipt of the self-priming floating pump within said space in a manner at least partially circumscribed by the fuel tank device; and at least one upper blocker is carried at a topside of the fuel tank device and movable between an extended position projecting inwardly from the fuel tank device over the open space bordered thereby the fuel tank device and a retracted position withdrawn from over the open space bordered by the fuel tank device.

11. The device of claim 10 wherein at least one lower blocker is carried at an underside of the fuel tank device, and is movable between a lower extended position projecting inwardly from the fuel tank device beneath the open space bordered by the fuel tank device and a lower retracted position withdrawn from beneath the open space bordered by the fuel tank device.

12. The device of claim 11 wherein a distance between the upper blocker and the lower blocker is at least as great as a height dimension of the self-priming floating pump at an outer periphery of a float body thereof.

13. The device of claim 11 wherein the lower blocker is connected to the upper blocker for movement therewith.

14. The device of claim 11 wherein for at least one blocker, there is provided a stop feature for preventing inadvertent movement of said at least one blocker between the two positions.

15. The device of claim 14 wherein the stop feature is an integral part of the fuel tank device.

16. The device of claim 10 wherein for at least one blocker, there is provided a stop feature for preventing inadvertent movement of said at least one blocker between the two positions.

17. The device of claim 16 wherein the stop feature is an integral part of the fuel tank device.

18. A fuel tank device for a self-priming floating pump, the fuel tank device comprising a float device arranged to be floatable independently of the self-priming floating pump and a fuel chamber carried by the float device for floating support of the fuel chamber by the float device:

wherein:

the fuel tank device spans more than 180-degrees around an axis passing through an open space that is bordered by said fuel tank device and dimensioned to accommodate receipt of the self-priming floating pump within said space in a manner at least partially circumscribed by the fuel tank device; and at least one lower blocker is carried at an underside of the fuel tank device and movable between a deployed position projecting inwardly from the fuel tank device beneath the open space bordered by the fuel tank device and a withdrawn position retracted from beneath the open space bordered by the fuel tank device.

19. The fuel tank device of claim 16 where the fuel tank device, over at least a partial span of a height thereof, comprises a gap in a span of the fuel tank device around the axis, the gap being of sufficient size to accommodate an outlet conduit of the self-priming floating pump.

20. The device of claim 19 wherein the fuel tank device has an annular shape closing fully around the open space, and the gap is defined over only the partial span of the fuel tank device by a cutaway recessed into an underside of the fuel tank device.

* * * * *